United States Patent [19]

Koenuma et al.

[11] 4,233,751

[45] Nov. 18, 1980

[54] UNIVERSAL PARALLEL RULER FOR THREE-DIMENSIONAL DRAWING

[75] Inventors: Masao Koenuma, Tokyo; Yoshitaka Gibu, Wakou, both of Japan

[73] Assignee: Asahi Seimitsu Kabushiki Kaisha, Tokyo, Japan

[21] Appl. No.: 30,738

[22] Filed: Apr. 17, 1979

[30] Foreign Application Priority Data

Apr. 20, 1978 [JP] Japan ..... 53-46828
Jun. 12, 1978 [JP] Japan ..... 53-70665

[51] Int. Cl.[3] ..... B43L 13/14
[52] U.S. Cl. ..... 33/434
[58] Field of Search ..... 33/432, 433, 434, 438–442, 33/430, 447, 403, 418, 424

[56] References Cited

U.S. PATENT DOCUMENTS 2,049,302 7/1936 Little ..... 33/441
3,826,007 7/1974 Senshu et al. ..... 33/432

FOREIGN PATENT DOCUMENTS 761930 11/1956 United Kingdom ..... 33/434

*Primary Examiner*—Harry N. Haroian
*Attorney, Agent, or Firm*—Birch, Stewart, Kolasch & Birch

[57] ABSTRACT

A universal parallel ruler is disclosed. The head of the ruler includes preset stoppers which are adjustably positioned according the three axes of the three-dimensional drawing. There are three stoppers. One is stationary, and two are adjustable. The scale can be selectively set to the basic three axes by locking engagement with the preset stoppers. The stationary stopper corresponds to the vertical axis Y whereas the adjustable stoppers may be angularly set and correspond to the remaining (X and Y) axes. A locking piece may be engaged with or disengaged from the preset stoppers so that the scales may be engaged with the preset stoppers after the stoppers have been angularly set as desired. Also, the three preset stoppers may be fixably or adjustably mounted on the ruler's protractor so that the three axes of the three-dimensional drawing may be independently set.

14 Claims, 11 Drawing Figures

UNIVERSAL PARALLEL RULER FOR THREE-DIMENSIONAL DRAWING

BACKGROUND AND SUMMARY OF THE INVENTION

The present invention generally relates to a universal parallel ruler for a three-dimensional drawing such as an isometric, dimetric or anisometric projection. Basically, the three-dimensional drawing is defined by three planes and all the circles contained to these three planes, corresponding to holes, shafts, etc., are drawn as ellipses. Each ellipse is determined by the ratio of its major and minor axes. The practical operation of drawing is performed using a template including many ellipses of various ratios arranged therein. In the universal parallel ruler for three-dimensional drawing of the prior art, in which three scales correspond to the basic three axes, one of the serious problems with the prior art ruler lies with the fact that three scales interfere with one another for effective use of the template. Each of the ellipses drawn in the basic three planes is determined by major and minor axes which are always perpendicular to each other. In view of these aspects, it would be extremely advantageous to have a universal parallel ruler, two scales which are always held perpendicular to each other for three-dimensional drawing because the template can be used without any interference with the respective scales and, further, the respective basic three axes and lines transverse to each of these basic three axes would be immediately obtained.

Although the means to set the scales at an interval of 15 or 30 degrees by cooperation of an index plate mounted on a head support and a locking pawl provided on the movable part of the head (i.e., on the scale side) is well known in the field of universal parallel rulers having two scales perpendicular to each other, it has been difficult to set the scales at intermediate angles which correspond neither to 15 degrees nor to 30 degrees. The same problem remains even when the index plate is movably arranged and adapted to the fixed at an optional position relative to the associated support, since only one of the basic three axes could be position-set and rest of the two axes have positions which are for every three-dimensional drawing.

In accordance with the present invention, the problem as described just above is overcome by an arrangement such that the head is provided with preset stoppers principally adapted to be optionally position-adjusted according to the basic three axes of a three-dimensional drawing and the scales can be selectively set to the basic three axes and can vary for every three-dimensional drawing. The preset stopper corresponding to the vertical axis of the basic three axes of the three-dimensional drawing may be stationarily provided since said vertical axis is in most cases drawn as a vertical line.

Also, according to the present invention, there is provided an arrangement such that a single locking piece is engaged with or disengaged from the preset stoppers respectively corresponding to the basic three axes so that the scales may be selectively set to to the respective preset stoppers which have been angularly set.

In a further preferred embodiment, the angularly preset stoppers can be fixably mounted by associated clamp members on the protractor and thereby the basic three axes can be independently set.

The present invention also provides a universal parallel ruler for three-dimensional drawing in which the scales can be set by operatively associating the protractor with the scales relative to a stationary index and fixing the protractor at a desired position to represent the three axes.

Accordingly, one object of the present invention is to provide a universal parallel ruler having scales which are fixedly mounted in perpindicular relationship with each other, yet maintain flexibility necessary for adjusting the scales for a variety of three-dimensional axes.

Another object of the present invention is to provide three preset stoppers which are engagable with the scales thereby permitting the scales to be angularly and adjustably varied in position relative to the preset stoppers coming into locking engagement with the preset stoppers. Another object of the present invention is to permit the preset stoppers to be angularly adjustable. Still another object of the present invention is to permit the preset stoppers to be fixedly or removably mounted onto the protractor portion of the parallel ruler so that the three axes of the three-dimensional drawing may be independendantly set.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
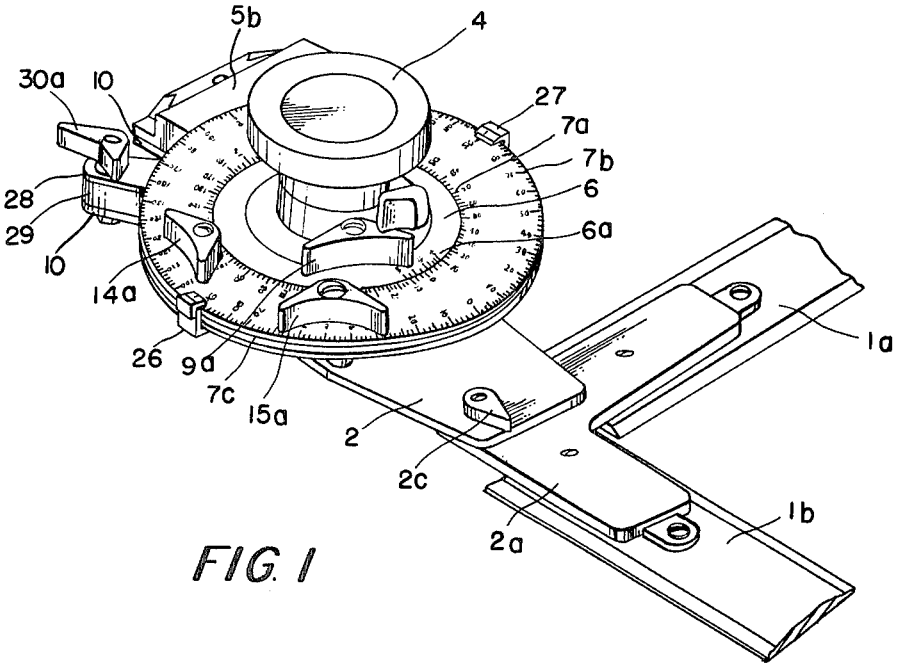
FIG. 1 is a perspective view illustrating an embodiment of the present invention.
Figure 2:
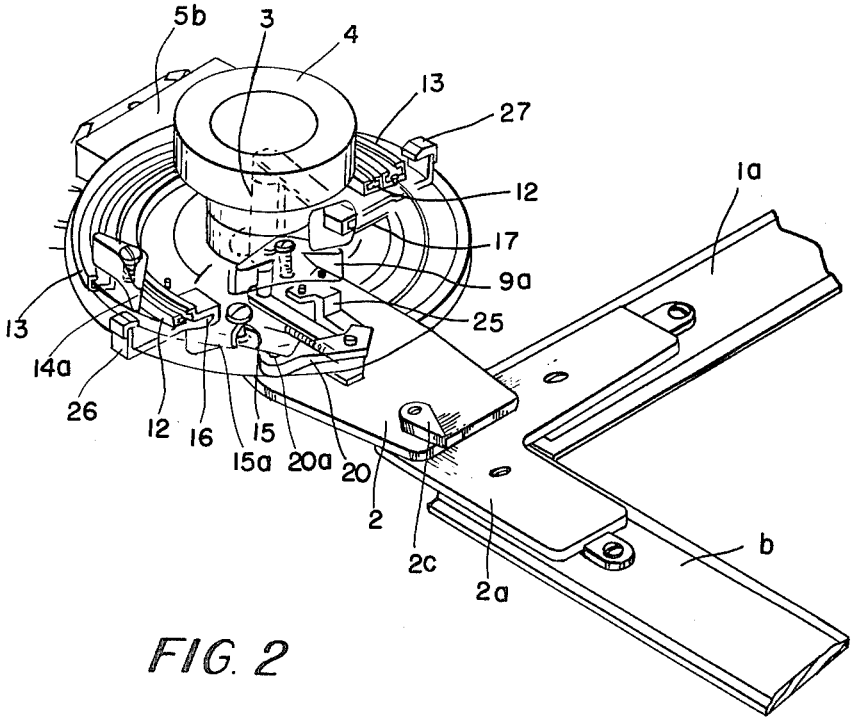
FIG. 2 is a schematic perspective view illustrating an important part of the embodiment of FIG. 1.
Figure 3A:
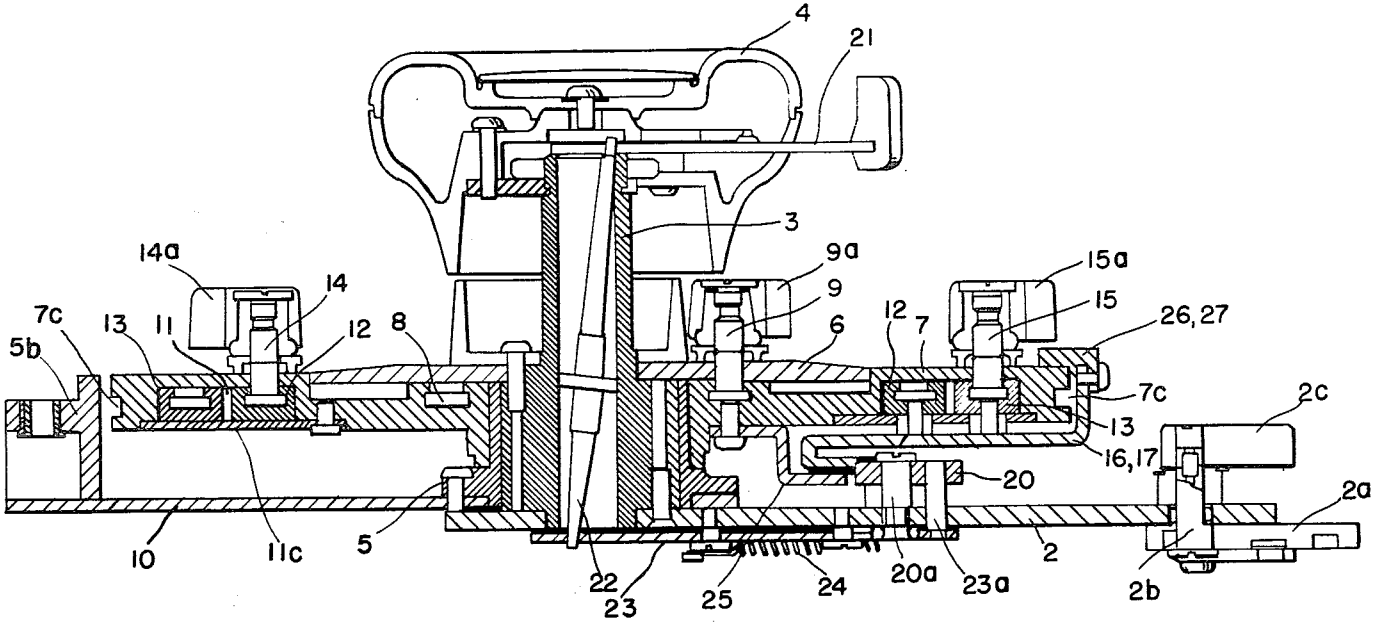
FIG. 3*a* is an axial section of the important part of FIG. 2 as taken along the axis of the head shaft.

Referring the FIGS. 1 and 2, reference numerals 1*a* and 1*b* respectively designate scales secured in a finely adjustable manner by a mounting plate 2*a* to a scale supporting member 2 so that the scales may be maintained perpendicular to each other. It is assumed here for a convenience of illustration that the reference numeral 1*b* designates the horizontal scale. Reference numeral 2*b* designates an eccentric shaft for a fine adjustment and reference numeral 2*c* designates a lever to operate said eccentric shaft. The scale supporting member 2 is, as well known, connected by a head shaft 3 to an operating head 4 in unison therewith and adapted to be rotated by the operating head 4. Reference numeral 5 designates a support for the head, which rotatably supports said head shaft 3 and is integrally provided with a connector portion 5*b* adapted to be connected through a support base 10 to a member such as a supporting link which is, in turn, connected to a cursor. The head shaft 3 is integrally provided at its upper portion with a circumferentially projecting frame 6 around which there is provided an index 6*a* comprising vernier graduations. Reference numeral 7 designates a protractor rotatably mounted with respect to said support 5 and said frame 6. The protractor 7 carries on its inner periphery, in opposition to said index 6*a*, protractor graduations 7*a* over angles of 180 degrees clockwise and counterclockwise, respectively, and similarly on its outer periphery the other protractor graduations 7*b*. A relationship between said protractor 7 and said frame 6 is such that, as best seen in FIG. 3*a*, the protractor 7 is provided with a circumferential slide groove 8 of rectangular-shaped cross-section in which a clamp member 9 extending through the frame 6 is mounted so as to clamp the protractor 7 together with the frame by clamping operation of a clamp lever 9*a* and said protractor 7 is made rotatable relative to said frame 6 by loosening said clamp lever 9*a*. In use, the frame 6 and the protractor 7 are generally clamped at a position where the reference values "O" of the index 6*a* and the protractor graduations 7*a* are lined up with each other, as shown by FIG. 1.

Figure 4:
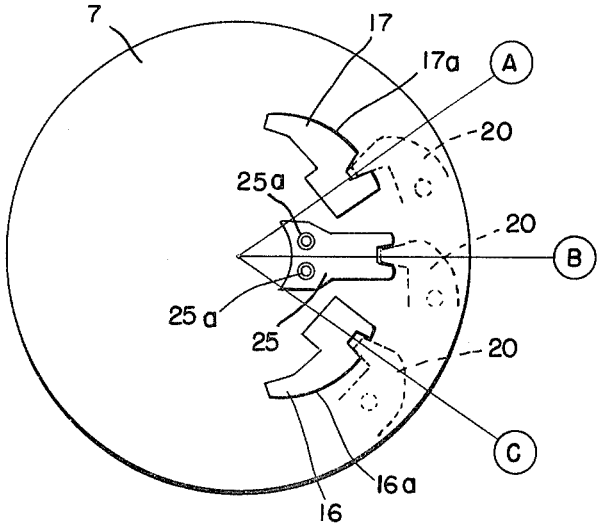
FIG. 4 is a schematic diagram illustrating the manner of use thereof.
Figure 5A:
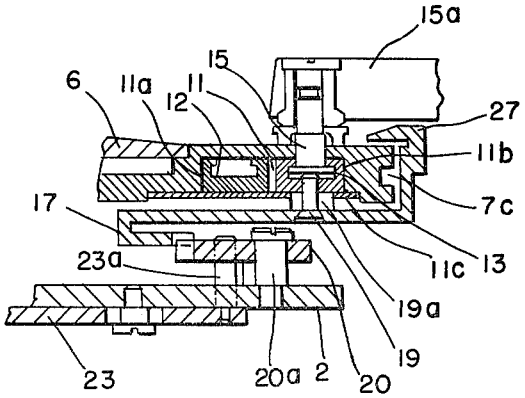
FIGS. 5*a* to 5*c* are partial axial sections of the important part of FIG. 2.
Figure 5B:
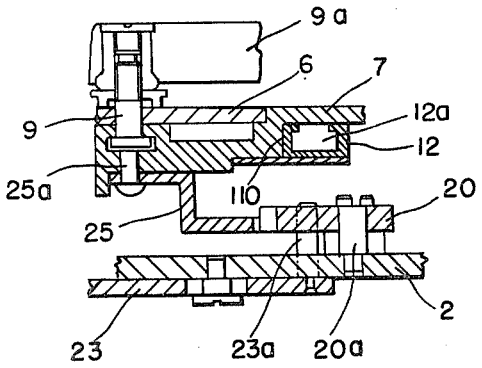
Figure 5C:
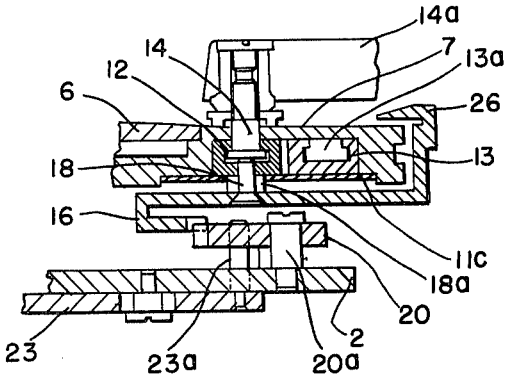

As shown in FIGS. 5*a* to 5*c*, the protractor 7 is circumferentially provided with a guide groove 11 and there are provided two guide members 12, 13 adapted to be rotatable along inner peripheral wall 11*a* and outer peripheral wall 11*b* of said guide groove 11, respectively. Said guide members, 12, 13, in the embodiment shown, comprise circular arc-shaped or annular members having slide grooves 13*a* each of arc-shaped cross-section, respectively, and are fitted into said guide groove 11. In said slide grooves 12*a*, 13*a* as seen in FIGS. 5*a* and 5*c*, respectively, there are mounted clamp members 14, 15 extending through the protractor 7 at predetermined positions, respectively. These guide members 12, 13 may be made rotatable or clamped under the effect of levers 14*a* and 15*a*, respectively. Beneath said guide members 12, 13, preset stoppers 16, 17 are fixably provided so as to be fixed by clamp screws 18, 19, respectively, at desired positions. Reference numeral 11*c* designates a bottom plate of said guide groove 11 which is fixed to the protractor 7 at a predetermined position so as to support the bottoms of the respective guide members 12, 13. The bottom plate 11*c* is provided with circular arc-shaped slots permitting the clamp screws 18, 19 to be displaced. As seen in FIG. 4, the preset stoppers 16, 17 respectively have engaging portions in the form of notches into which a locking piece 20 in form of a pawl of the scale supporting member 2 is selectively and disengageably engaged. Said pawl 20 is pivotally mounted on the scale supporting member 2 around a pivot 20*a*, as seen in FIG. 3*a*, so that a pushing force exerted upon a movable lever 21 laterally projecting from the operating head 4 is transmitted by a lever 22 mounted within a cavity of said head shaft 3 to a linkage lever 23 and thus a pin 23*a* causes the pawl 20 to swing away from the notches of said preset stoppers 16, 17. Engagement of said pawl 20 with the respective preset stoppers 16, 17 is effected under the action of a tension spring 24. As illustrated by FIG. 4, the preset stoppers 16, 17 are formed with guide surfaces 16*a*, 17*a*, respectively, to facilitate smooth engagement of the pawl 20 into the notches of the respective preset stoppers 16, 17.

Figure 6A:
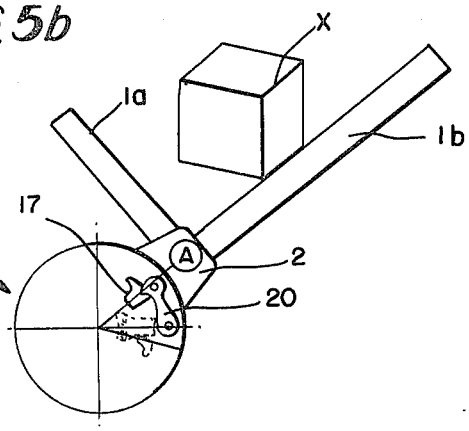
FIGS. 6*a* to 6*c* are schematic diagrams illustrating the manner of use thereof.
Figure 6B:
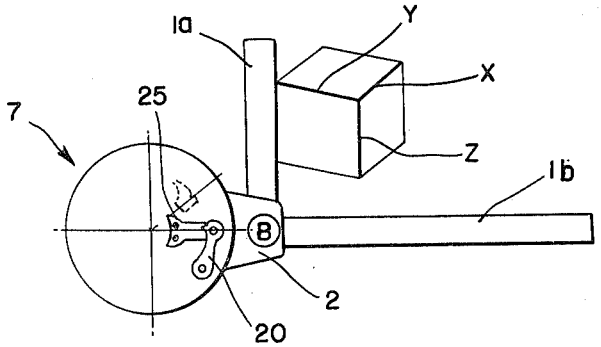

Said preset stoppers 16, 17 are useful for adjustably setting two axes of the three basic axes in the three-dimensional drawing and a separate preset stopper associated with the remaining axis may be stationarily mounted on the protractor since the remaining axis is drawn in the ordinary three-dimensional drawing as the vertical line, as seen in FIG. 6*b*. Reference numeral 25 designates this stationary preset stopper which has been fixed by clamp screws 25*a* to the protractor 7 so that the notch thereof is located on the circular portion and on which also the notches of the preset stoppers 16, 17 are located, as seen in FIG. 4, but lower than said preset stoppers 16, 17 as readily understood from the height relationship with the pawl 20 shown in FIG. 3*a*. In this way, said adjustable preset stoppers 16, 17 can be angularly displaced beyond the stationary preset stopper 25 and, for example, the preset stoppers 17, 16 can be angularly set to position, respectively, clockwise and counterclockwise as seen in FIG. 4 beyond the stationary preset stopper 25. When these adjustable preset stoppers 16, 17 are set adjacent to the stationary preset stopper 25, the previously mentioned guide surfaces 16*a* and 17*a* serve to prevent the pawl-like end of the locking piece 20 from being engaged into the notch of the stationary preset stopper 25. The adjustable preset stoppers 16, 17 are integrally provided, in association with the protractor graduations 7*b*, with indices 26, 27 respectively, so that the angular setting of the preset stoppers 16, 17 may be achieved according to positions of these indices. Obviously it is also possible to provide these indices 26, 27 with vernier graduations, respectively. It is also obvious that the stationary preset stopper 25 should be set to the reference value "O" on the protractor graduations.

In view of the fact that the minimum function of the preset stoppers 16, 17, 25 is to stop the scale supporting member (i.e., the scales) at the angularly set position, these may be the stoppers of abutting type, adapted to prevent the scale supporting member from rotating in one direction. In such a case, one of the abutting parts may be provided with a magnet to prevent the scale supporting member from moving in the opposite direction. The preset stoppers are thus required at least to exert a restraining force upon the scale supporting member enough for temporarily stopping the latter, so that said preset stoppers may be executed as those of click type to release the scale supporting member from the restraining effect acting thereupon when a rotating torque thereof exceeds a predetermined level of those utilizing the action of a magnet spaced thereof.

Figure 3B:
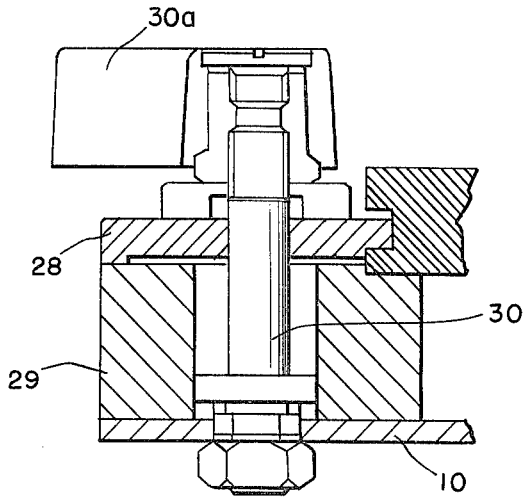
FIG. 3*b* is a partial axial section of the important part of FIG. 2.

The protractor 7 rotatably mounted with respect to the head support 5 is provided along its outer periphery with a groove 7*c* of rectangular-shaped cross-section into which, as seen in FIG. 3*b*, one end of a presser plate 28 is engaged. Said presser plate 28 is mounted by a collar 29 on the support base 10 outwardly projecting from the protractor 7, as seen from FIGS. 1 and 2, and a clamp screw having its lower end fixed to said support base 10 extends through the collar 29 and the presser plate 28 substantially at center thereof to clamp a clamp lever 30*a* provided above said presser plate 28 so that the protractor 7 may be clamped and held between said presser plate 28 and said collar 29. Accordingly, the protractor 7 becomes rotatably together with the head shaft 3 and the scales once the lever 30*a* has been loosened and, from this state, the lever 9*a* arranged between the frame 6 and the protractor 7 may be loosened to make the protractor 7 rotatable independently of the head shaft 3 as well as the scales.

The manner of use of the universal parallel ruler according to the present invention of the arrangement as described hereinabove will be described.

Figure 6C:
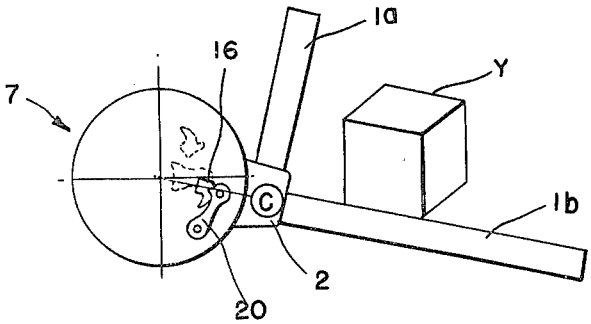

Referring to FIGS. 6*a* to 6*c* in which the three basic axes of a three-dimensional drawing are designed by X, Y and Z, respectively, the adjustable preset stoppers 17, 16 and the stationary preset stopper 25 may be associated with axes X, Y and Z, respectively. Namely, the adjustable preset stoppers 17, 16 associate the indices 27, 26 with the protractor graduates 7*a* carried by the protractor 7 so as to set the axes X and Y, respectively, and the axis Z is set by the preset stopper 25 fixed on the reference position on said protractor graduations because the axis Z is drawn as the vertical line. By clamping the clamp levers 15*a*, 14*a*, respectively, after the angular setting has been done, the guide members 13, 12 are fixed to the protractor 7 and the preset stoppers 17, 16 fixed to said guide members 13, 12, respectively, are also fixed together with the indices 27, 26 to the protractor 7. Thus, three basic axes X, Y and Z of the three-dimensional drawing can be respectively drawn, as seen in FIGS. 6*a* to 6*c*, by loosening the clamp lever 9*a*, operating the removable lever 21 laterally projecting from the operating head 4, and selectively engaging the locking piece 20 to the scale supporting member 2 with said preset stoppers 17, 16 25, respectively. By rotating the protractor 7 relative to the support 5 and the support base 10 with the clamp lever 20*a* being loosened, a three-dimensional drawing can be drawn at a rotated position with respect to the drawing plane and at a predetermined angle without varying the relationship among these basic three axes X, Y and Z of the three-dimensional drawing. Thus, it is not necessary for the preset stoppers themselves to be adjustable, in the embodiment shown, as long as the protractor 7 is rotatably arranged in the manner as mentioned above.

This further means that, when the previously set base line of the scales does not line up with the base line of a new drawing, in normal drawing procedures such as draft exchange, the scales may be rotated together with the protractor 7 with the clamp lever 30*a* to use the scales with the new base line, improving the efficiency of the drawing operation. Furthermore, the angle by which the scales have been rotated can be readily read from the index 6*a* on the frame 6 rotating integrally therewith and the protractor graduations 7*a* on the protractor 7. By rotating the scales with the clamp levers 10*a* and 15*a* being loosened from the locked state, that is the locking pieces 20 in engagement with the preset stopper 16 or 17, it is possible to set the preset stopper at an optional angular position.

As will be obvious from the foregoing description, with respect to the universal parallel ruler for three-dimensional drawing according to the present invention, the preset stopper associated with at least one of three basic axes of a three-dimensional drawing can be set at an optional angle relative to the protractor and the scales can be angularly set by bringing the scale supporting member against said preset stopper, so that, for example, two scales are always held perpendicular to each other and may be brought into coincidence selectively with the preset stopper which was previously set to the basic three axes.

Such arrangement provides various advantages, for example, it is easily possible to draw the lines parallel or perpendicular to the basic three axes by bringing two scales, which are always held perpendicular with respect to each other, in coincidence selectively with the preset stoppers respectively set to the basic three axes, the ellipses to be drawn in the basic three planes of the three-dimensional drawing can be easily drawn using a template without any interference with the scales, and said scales held perpendicular to each other simply defines the perpendicularity between the major and minor axes of an ellipse. Furthermore, with the specific embodiment so arranged that, when the scale supporting member is brought against the adjustable preset stopper, both components are integrally coupled to each other with the locking piece of the former being engaged into the notch of the latter, it is possible not only to surely fix the scale supporting member to the preset stopper after the angular setting thereof, but also to unite the scale supporting member with the preset stopper before the angular setting thereof. With another arrangement such that the protractor is provided with the guide groove, the guide members are adapted to be optionally locked along said guide groove and the preset stoppers are mounted on the respective guide members. Therefore, the preset stoppers can be respectively set at given angles by individually fixing the respective guide members to the protractor, even when these are provided in association with the basic three axes of the three-dimensional drawing. Furthermore, with the arrangement such that said preset stoppers are located on the same circular arc as the circular arc along which the scale supporting member is rotated, the scale supporting member can be engaged with or disengaged from the respective preset stoppers simply by operating a single locking piece of the scale supprting member.

Moreover, for angular change with respect to the base line in the case such as exchange of draft, the scale can be brought together with the protractor into coincidence with a new base line with the scale index remaining aligned with the base line position of the protractor graduation carried by the protractor and thereby changing of the base line can be easily achieved at a high precision.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A universal parallel ruler for a three-dimensional drawing including a protractor disc and at least one scale, comprising:

preset stopper means corresponding to at least one of said the basic three axes of said three-dimensional drawing, said preset stopper means for angularly adjusting said at least one scale relative to said protractor disc; and scale supporting means for supporting said at least one scale, said scale supporting means positively engaging said preset stopper means for angularly setting said at least one scale to align said scale with one of the basic three axes of said three-dimensional drawing.

2. A universal parallel ruler for use with a three-dimensional drawing as defined by claim 1, wherein said preset stopper means comprises an index means for measuring the angular position of said scale, said index means being disposed opposite to the graduations on said protractor disc.

3. A universal parallel ruler including a protractor disc and scales attached thereto for use in three-dimensional drawing, comprising:

a plurality of preset stopper means for angularly adjusting said scales relative to said protractor disc, one of said preset stopper means corresponding to at least one of the basic axes of said three-dimensional drawing, each of said preset stopper means having a receiving portion; and scale supporting member means for positively engaging said preset stopper means for angularly setting said scales to align one of said scales with one of the basic three axes of said three-dimensional drawing, said scale supporting member means including an engaging portion selectively secured to said receiving portion thereby permitting said preset stopper means to be removably engaged to said scale supporting member means.

4. A universal parallel ruler for use with a three-dimensional drawing as defined by claim 3, wherein said receiving portion of said preset stopper means comprises a groove; and wherein said engaging portion of said scale supporting means includes a claw, said claw being selectively secured in said groove.

5. A universal parallel ruler for use with three-dimensional drawing is defined by claim 3 further comprising:

a magnet member adapted to be mounted on said receiving portion of said preset stopper means and said engaging portion of said scale supporting means; and wherein said receiving portion and said engaging portion are selectively secured to each other in response to the action of said magnet member.

6. A univeral parallel ruler including at least one scale for use in three-dimensional drawing, comprising:

at least one preset stopper means corresponding to at least one of the basic three axes of a three-dimensional drawing, said at least one preset stopper means for angularly adjusting said at least one scale relative to said protractor disc;

a scale supporting member means for positively engaging said preset stopper means for adjustably setting the angle of said at least one scale to align said scale with one of the basic three axes of said three-dimensional drawing; and a protractor disc including a guide groove and a member fixed at a desired position along said groove;

said preset stopper means being stationarily mounted on said guide member.

7. A universal parallel ruler including a protractor disc, a head and at least one scale for use in three-dimensional drawing, comprising:

stationary stopper means for locking said at least one scale to one of the basic three axes of said three-dimensional drawing;

two angularly adjustable preset stopper means corresponding to the remaining two axes of said three-dimensional drawing for angularly adjusting said at least one scale; said two angularly adjustable preset stopper means being mounted on the head; and two movable guide members selectively fixed at desired positions relative to said protractor disc;

said two angularly adjustable preset stopper means corresponding to the remaining two axes of said three-dimensional drawing being mounted on said two guide member means;

said two angularly adjustable preset stopper means being located on the same circular arc with respect to said stationary stopper means.

8. A universal parallel ruler for use in three-dimensional drawing, comprising:

a head shaft;

a protractor concentrically located around said shaft, said protractor having a plurality of preset stoppers attached thereto and adapted to be set to the basic three axes of said three-dimensional drawing, at least one of said preset stoppers being rotatable about said head shaft; and a scale supporting member having a locking piece attached thereto, said scale supporting member rotating with said head shaft thereby permitting said scale supporting member to be brought into engaging relationship with one of said plurality of preset stoppers.

9. A universal parallel ruler according to claim 8 wherein one of said plurality of preset stoppers is stationarily mounted on said protractor at a position corresponding to the base line of said protractor; and wherein the remaining ones of said plurality of preset stoppers are angle adjustably mounted on said protractor.

10. A universal parallel ruler according to claim 8 wherein said plurality of preset stoppers include index means for angularly setting said pluarlity of preset stoppers relative to said protractor.

11. A universal parallel ruler according to claim 10 wherein said protractor includes a first set of protractor graduations on the inner periphery of said protractor; and a second set of protractor graduations on the outer periphery of said protractor.

12. A universal parallel ruler according to claim 8 wherein each of said plurality of preset stoppers comprise an engaging portion;

said scale supporting member including a locking piece selectively secured to said engaging portions of each of said plurality of preset stoppers.

13. A universal parallel ruler according to claim 8 wherein said protractor includes a plurality of fixable guide members in a rotatable engagement therewith, said plurality of preset stoppers being stationarily mounted on said plurality of guide members.

14. A universal parallel ruler according to claim 12 wherein said engaging portions of said plurality of preset stoppers are arranged on a common circumference with said locking piece of said scale supporting member, said locking piece permitting said scale supporting member to be engaged with and disengaged from respective ones of said plurality of preset stoppers.

* * * * *